US010011993B2

(12) United States Patent
Grubbs

(10) Patent No.: US 10,011,993 B2
(45) Date of Patent: Jul. 3, 2018

(54) ROOFING TOOL FOR CLEANING SEAMS OF ROOFING PLIES

(71) Applicant: Robbi R. Grubbs, Herculaneum, MO (US)

(72) Inventor: Robbi R. Grubbs, Herculaneum, MO (US)

( * ) Notice: Subject to any disclaimer, the term of this patent is extended or adjusted under 35 U.S.C. 154(b) by 301 days.

(21) Appl. No.: 14/993,274

(22) Filed: Jan. 12, 2016

(65) Prior Publication Data

US 2016/0201333 A1 Jul. 14, 2016

Related U.S. Application Data

(60) Provisional application No. 62/103,243, filed on Jan. 14, 2015.

(51) Int. Cl.

| | |
|---|---|
| ***E04D 15/00*** | (2006.01) |
| ***E04D 15/04*** | (2006.01) |
| ***B25G 1/00*** | (2006.01) |

(52) U.S. Cl.

CPC ..... *E04D 15/006* (2013.01); *B25G 1/00* (2013.01); *E04D 15/04* (2013.01); *Y10T 16/473* (2015.01)

(58) Field of Classification Search

CPC ..... E04D 15/006; E04D 15/04; B25G 1/00; Y10T 16/473; A47L 4/02

USPC ..... 15/104.001, 104.94, 105, 210.1

See application file for complete search history.

(56) References Cited

U.S. PATENT DOCUMENTS

| | | | | | |
|---|---|---|---|---|---|
| 2,896,243 | A * | 7/1959 | Schoenfield | A47L 4/02 | 15/118 |
| 4,528,712 | A * | 7/1985 | Leibow | B05C 17/00 | 15/118 |
| 4,548,016 | A * | 10/1985 | Dubich | E04D 15/04 | 404/107 |
| 4,737,213 | A * | 4/1988 | Paeglis | B29C 66/86521 | 156/157 |
| 4,861,400 | A * | 8/1989 | Sargent | B29C 66/342 | 156/574 |
| 4,894,112 | A * | 1/1990 | Lippman | B29C 66/1122 | 156/308.4 |
| 4,985,958 | A * | 1/1991 | Garcia | B05C 17/0222 | 15/114 |
| 6,135,934 | A * | 10/2000 | Couch | E04D 15/04 | 15/230.11 |
| 6,367,121 | B1 * | 4/2002 | MacMillan | B25G 1/04 | 15/235.8 |

(Continued)

*Primary Examiner* — Weilun Lo

(74) *Attorney, Agent, or Firm* — Thompson Coburn LLP

(57) ABSTRACT

A roofing tool has a tubular member with a length and opposite proximal and distal ends. The proximal end is configured to be grasped by a user and the distal end has an opening into a hollow interior of the tubular member. A shaft has a length with opposite proximal and distal ends. The shaft is disposed in the interior of the tubular member and movable therein. The shaft proximal end corresponds generally to the tubular member proximal end and the shaft distal end extends through the tubular member distal end opening. A roller is operatively connected to the distal end of the shaft. The roller is configured to rotate about a roller axis which is perpendicular to the shaft length. A cleaning pad is spaced from the distal end of the tubular member and the roller. The cleaning pad extends in a direction transverse to the tubular member length.

18 Claims, 8 Drawing Sheets

(56) References Cited

U.S. PATENT DOCUMENTS

| | | | | |
|---|---|---|---|---|
| 2004/0002414 | A1* | 1/2004 | Barksdale | E04D 5/145 492/13 |
| 2005/0050663 | A1* | 3/2005 | Goulet | B05C 17/0205 15/144.4 |
| 2012/0144626 | A1* | 6/2012 | Lanz | B25G 1/04 16/427 |

* cited by examiner

ROOFING TOOL FOR CLEANING SEAMS OF ROOFING PLIES

RELATED APPLICATION DATA

This application claims the benefit of provisional application Ser. No. 62/103,243, filed Jan. 14, 2015, the disclosure of which is incorporated herein by reference.

BACKGROUND AND SUMMARY

The present disclosure relates to a tool that cleans the seams of single ply roofing flexible sheets, for instance, thermoplastic polyolefin and polyvinyl chloride roofing systems, during installation. Often, these roofing systems include single ply flexible sheets that are bonded together using hot air. Before bonding the plies together, they are cleaned. The tool described herein allows the user to simultaneously clean the bottom surface of one ply and the top surface of another ply. In one aspect of the application, one ply may be installed on the roof structure and the other ply may be positioned adjacent the installed ply prior to bonding the plies together. In this arrangement, the tool allows the user to clean the top surface of the installed ply and the bottom surface of the ply to be installed by advancing the tool across the edge of the installed ply. In this way the areas adjacent to the edges of the plies may be cleaned before the plies are bonded together.

DETAILED DESCRIPTION

Figure 1:
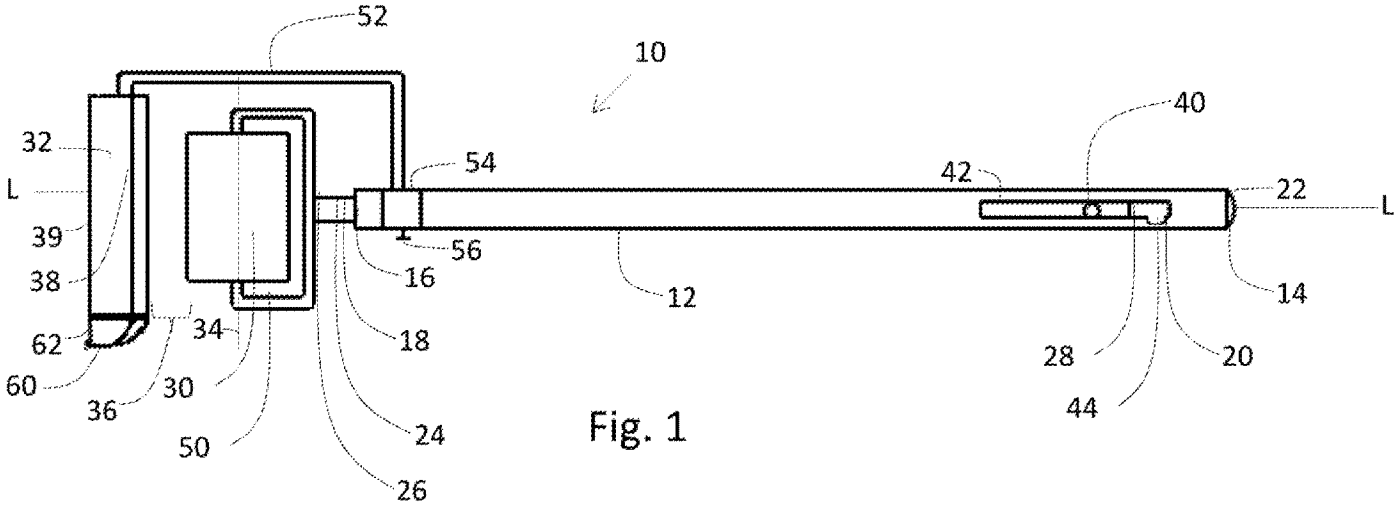
FIG. 1 is a top view of the tool with a roller of the tool in an extended position.

The cleaning tool 10 comprises a tubular member 12 having a length extending along an axis L with opposite proximal and distal ends 14,16. The proximal end 14 is configured to be grasped by a user and the distal end 16 is spaced away from the proximal end by the length of the tubular member 12. The tubular member distal end 16 has an opening 18 into a hollow interior 20 of the tubular member. The proximal end 14 of the tubular member may have a cap 22 to seal the hollow interior 20 at the proximal end. The tubular member 12 may be made from a material of sufficient strength to prevent deflection or buckling along its length but sufficiently light weight so as to not encumber its use. Although not shown in the drawings, the length of the tubular member 12 may be adjusted as needed depending upon the height, or other requirements, of the user.

Within the hollow interior 20 of the tubular member 12, an elongated shaft 24 is disposed. The shaft 24 has a length extending along, and preferably collinear with, the axis L with opposite distal and proximal ends 26,28. The length of the shaft 24 may be less than the length of the tubular member 12 so as to allow the shaft to slide within the hollow interior 20 of the tubular member. The diameter of the shaft 24 may be sized for a neat or loose sliding fit with the inner diameter of the tubular member 12. The shaft proximal 28 end corresponds generally to the tubular member proximal end 14 and the shaft distal end 26 extends through the tubular member distal end opening 18.

A roller 30 and cleaning pad 32 are provided generally at the distal end of the tubular member 16. The roller 30 is operatively connected to the distal end 26 of the shaft 24 and the cleaning pad 32 is operatively connected to the distal end 16 of the tubular member 12. The roller 30 is configured to rotate about a roller axis 34 that is perpendicular to the direction corresponding to the axis L. The cleaning pad 32 is spaced from the distal end 16 of the tubular member 12 and the roller 30, and extends in a direction generally transverse to the tubular member length direction and the axis L. A space 36 is formed between the roller 30 and the cleaning pad 32. A ply may be inserted into the space 26. As will be described, after the ply is inserted into the space 36, the roller 30 rotates on the top surface of the one ply, for instance, the ply to be installed, while the top surface of the cleaning pad 38 engages the bottom surface of the same ply (e.g., the ply to be installed), and the bottom surface 39 of the cleaning pad engages the top surface of the other ply (e.g., the installed ply). The roller 30 may be made from a neoprene or other non-reactive material. The roller 30 may be weighted to apply pressure to the top surface of ply so as to force the bottom surface of the ply against the top of the cleaning pad. As will be described below in greater detail, the cleaning pad 32 is configured to retain and apply a cleaning solution to the plies.

Figure 2:
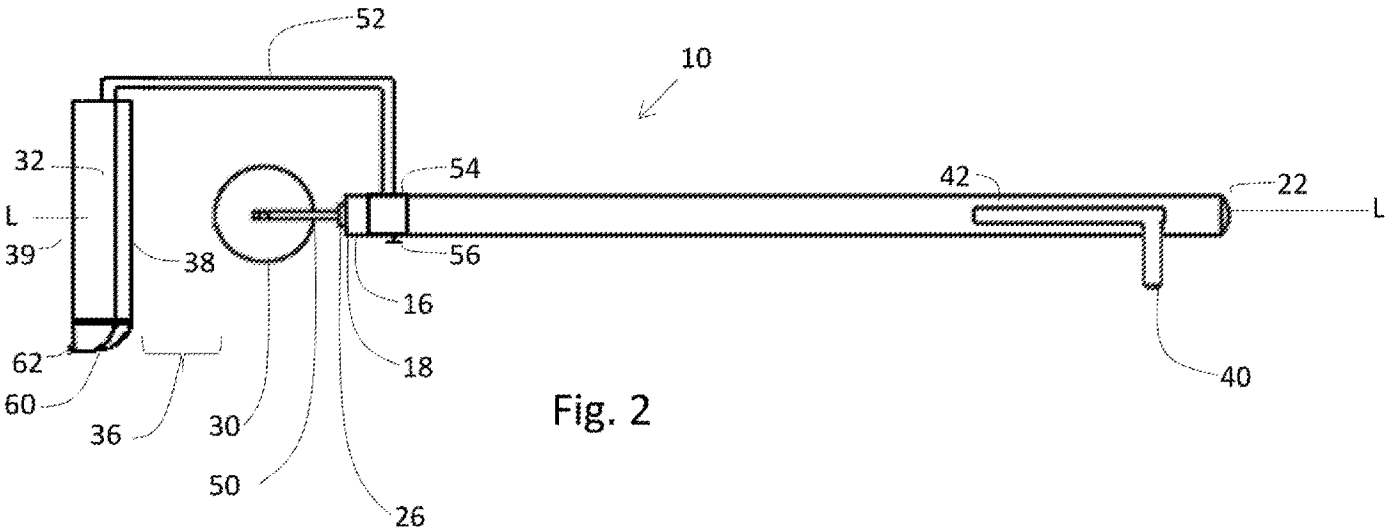
FIG. 2 is a top view of the tool of FIG. 1 with the roller in a retracted position.
Figure 3:
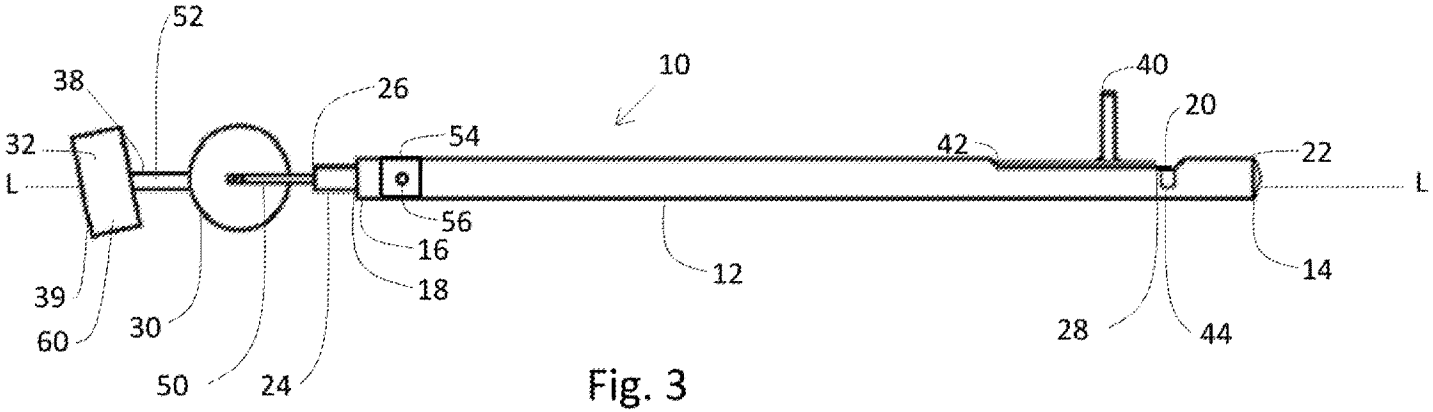
FIG. 3 is a front view of the tool of FIG. 1 with the roller in an extended position.
Figure 4:
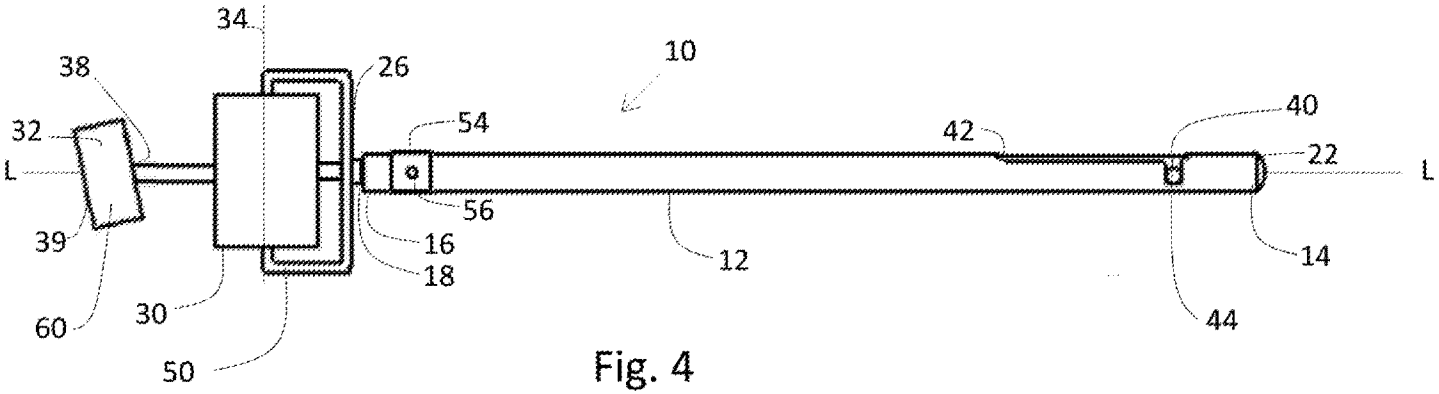
FIG. 4 is a front view the tool of FIG. 2 with the roller in the retracted position.
Figure 5:
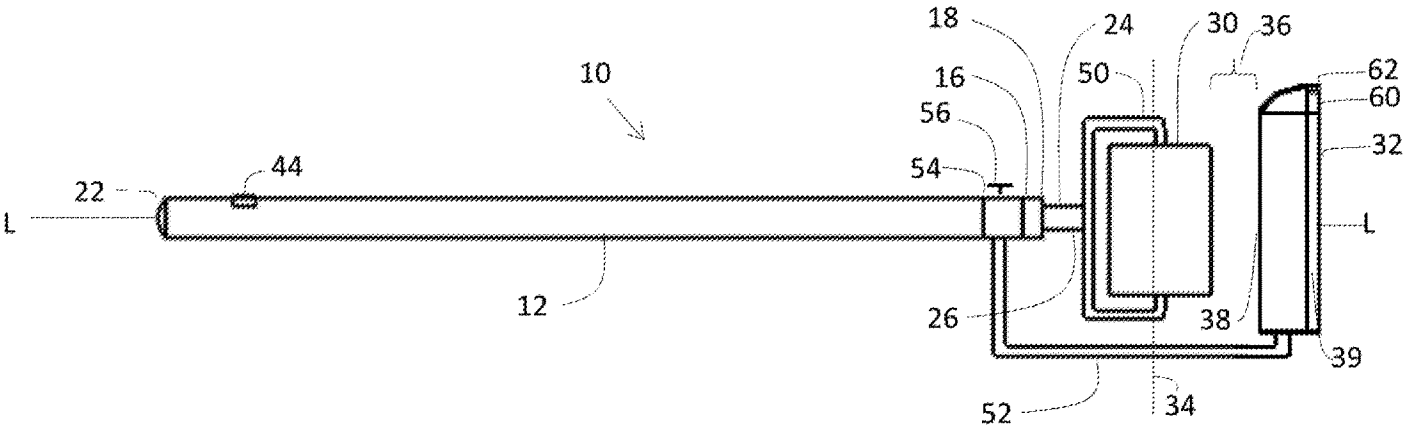
FIG. 5 is a bottom view of the tool of FIG. 1.
Figure 6:
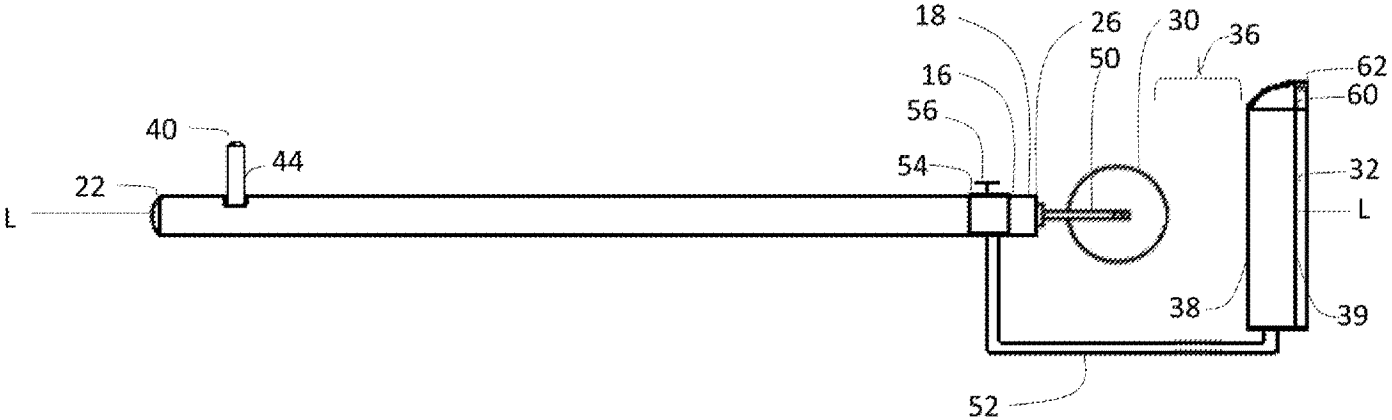
FIG. 6 is a bottom view of the tool of FIG. 2.
Figure 7:
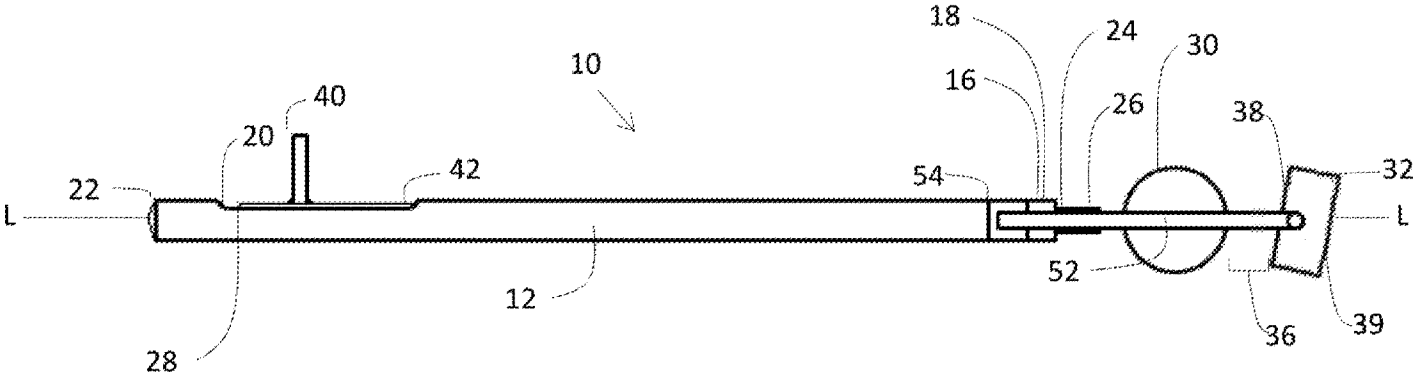
FIG. 7 is a rear view of the tool of FIG. 1.
Figure 8:
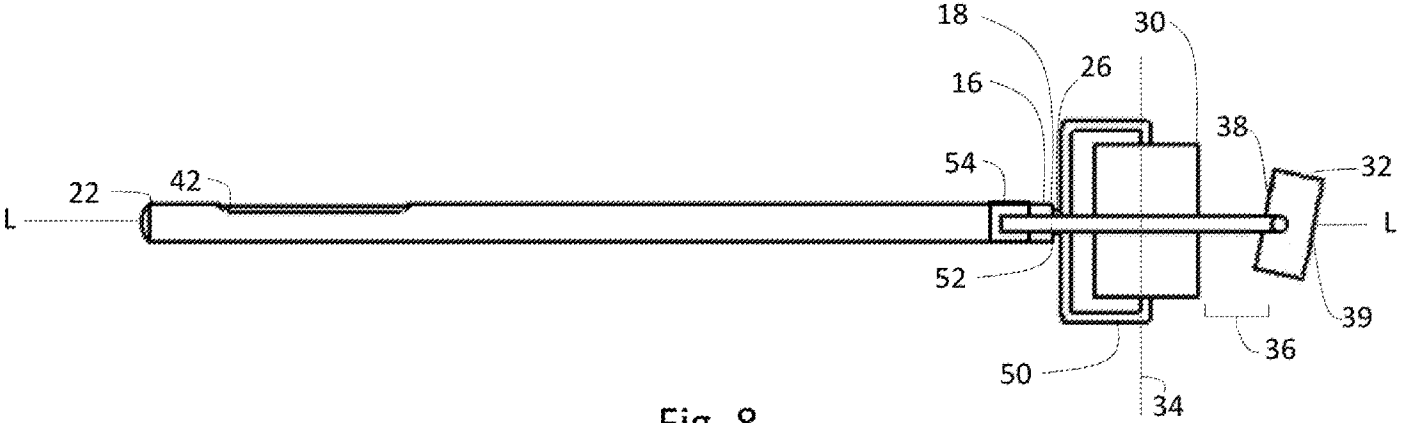
FIG. 8 is a rear view of the tool of FIG. 2.

The shaft 24 is positionable relative to the tubular member 12 between an extended position and a retracted position. In in the extended position, the shaft 26 proximal end may be positioned away from the tubular member proximal end 16 and the roller 30 may be positioned toward the cleaning pad 32 and away from the tubular member distal end 16 to decrease the space 36. In the retracted position, the shaft proximal end 26 may be positioned toward the tubular member proximal end 16 and the roller 30 is positioned away from the cleaning pad 32 and toward the tubular member distal end 16 to increase the space. In the retracted position, the shaft 24 may be received through the tubular member distal end opening 18 into the hollow interior 20 of the tubular member. In the extended position, the distance of the space 36 between the roller 30 and the cleaning pad 32 is less than the distance of the space between the roller and the cleaning pad in the retracted position. For instance, as shown in FIG. 1, the shaft 24 may be moved to an extended position in which the roller 30 is in relatively close proximity to a top surface 38 of the cleaning pad (the bottom surface of the cleaning pad being indicated by character 39). In FIG. 2, the roller 30 is positioned away from the top surface 38 of the cleaning pad. In FIG. 2, the roller 30 is also rotated 90 degrees relative to its position in FIG. 1 as will be explained in greater detail below. In FIG. 1, in the extended position, the roller 30 is positioned in close proximity to the cleaning pad 32 to allow cleaning operations to occur. When cleaning operations are complete, the roller 30 may be moved to the retracted position and away from the cleaning pad 32, for instance, as shown in FIG. 2, so as to allow the tool to be removed from between the plies.

The shaft may include a handle 40 to allow the operator to move the shaft and the roller 30 between the extended position and the retracted position. The handle 40 may slide in a slot 42 formed in the tubular member 12. The slot 42 may extend longitudinally along the axis L along a section of the length of the tubular member 12. The handle 40 may project from the slot 42. The handle may be monolithically formed with the shaft or may be integrally or removably connected therewith. As best shown in FIG. 2, the slot 42 may be provided with a recess 44 formed perpendicularly to the slot adjacent to the proximal end 14 of the tubular member. The recess 44 may extend perpendicularly to the slot 42 and provide a stop location for the retracted position and a location into which the handle 40 may be positioned. Thus, as shown in the figures, when the shaft is moved to the retracted position, the handle 40 may come into alignment with the recess 44. The user may rotate the handle 40 from the slot 42 into the recess 44 and lock the shaft 24 in the retracted position. This action may also rotate the roller 30 about the axis L, for instance, by 90 degrees as shown in FIG. 2, to facilitate extraction of the cleaning tool from between the plies. When the user is ready to begin cleaning operations again, the handle 40 may be pivoted about the axis L in the opposite direction, for instance, by 90 degrees as shown in FIG. 2, such that the handle 40 exits the recess 44 and enters the slot 42. The handle 40 may then be moved forward in the slot 42 toward the tubular member distal end 16 to position the shaft 24 to the extended position.

The distal end 26 of the shaft 24 may be provided with yoke 50, and the roller 30 may be rotatably connected to the yoke 50 about the roller center axis 34. The yoke 50 may be connected to the shaft 24 in such a way that the yoke 50 and roller center axis 34 are positioned transversely to the handle 40. In this configuration, rotation of handle 40 will correspond to rotation of the shaft 24, rotation of the yoke 50, and rotation of the roller 30 about the axis L.

The distal end of the tubular member 16 includes an arm 52 that connects to the cleaning pad 32. The arm 52 has a portion that extends laterally and a portion that extends longitudinally from the distal end 16 of the tubular member 12 in a general U-shaped or J-shaped configuration. One leg of the U-shaped or J-shaped configuration is connected to the cleaning pad 32 and the opposite leg of the U-shaped or J-shaped configuration is connected to the tubular member distal end 16. The U-shaped or J-shaped configuration creates the space 36 between the roller 30 and the cleaning pad 32 into which an edge of a ply may be fed. With arm 52 in the U-shaped or J-shaped configuration, an edge of the ply may be inserted in the space 36 between the roller 30 and the cleaning pad 32 to allow cleaning operations to occur. Should the user wish to reposition the opening of the space 36 from one lateral side of the tubular member 12 to the other lateral side of the tubular member, for instance, so as to allow insertion of the edge of the ply on the other of the left side of the tool or the right side of the tool, a user may unlock a locking collar 54 and rotate the arm 52 and locking collar around the outer surface of the tubular member 12 to position the arm as needed. The locking collar 54 may be secured in position with a set screw or mechanical fastener 56. In one aspect, should the user wish to reorient the configuration of the arm 52, the user may loosen the mechanical fastener 56 and rotate the locking collar 54 to the desired orientation.

Figure 9:
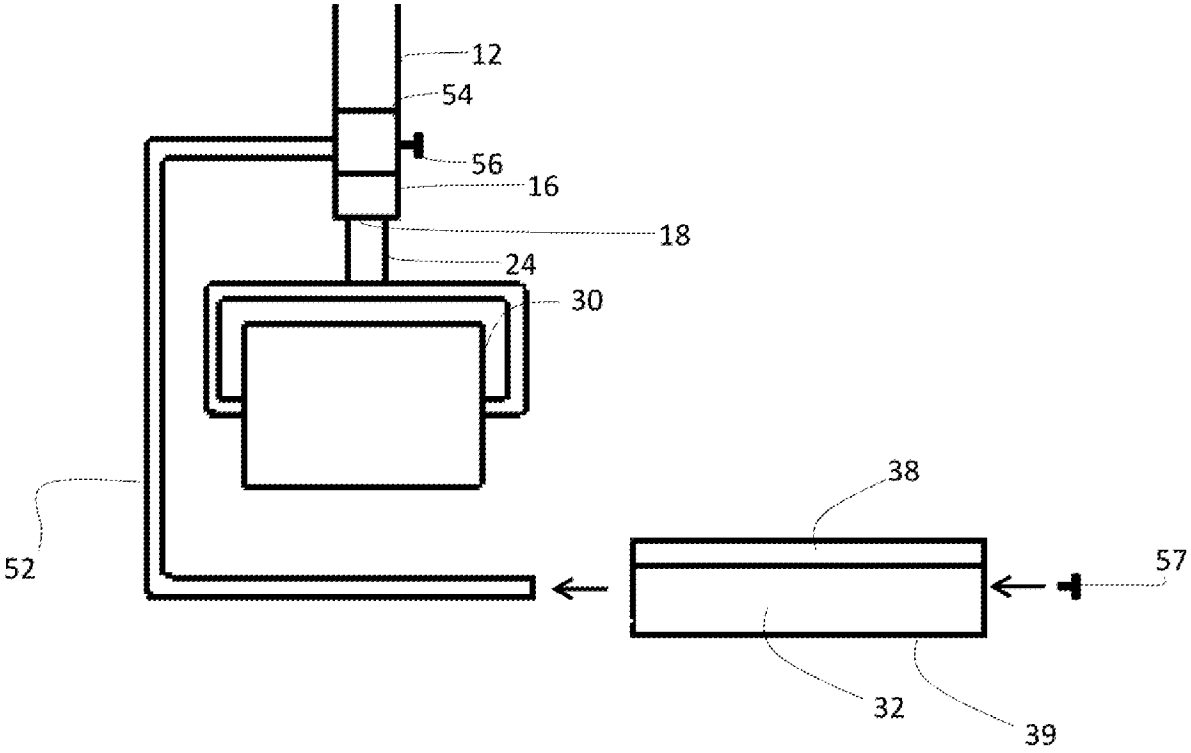
FIG. 9 is an enlarged view of the distal end of the tool of FIG. 1, showing an exploded view and additional detail of a cleaning pad of the tool.
Figure 10:
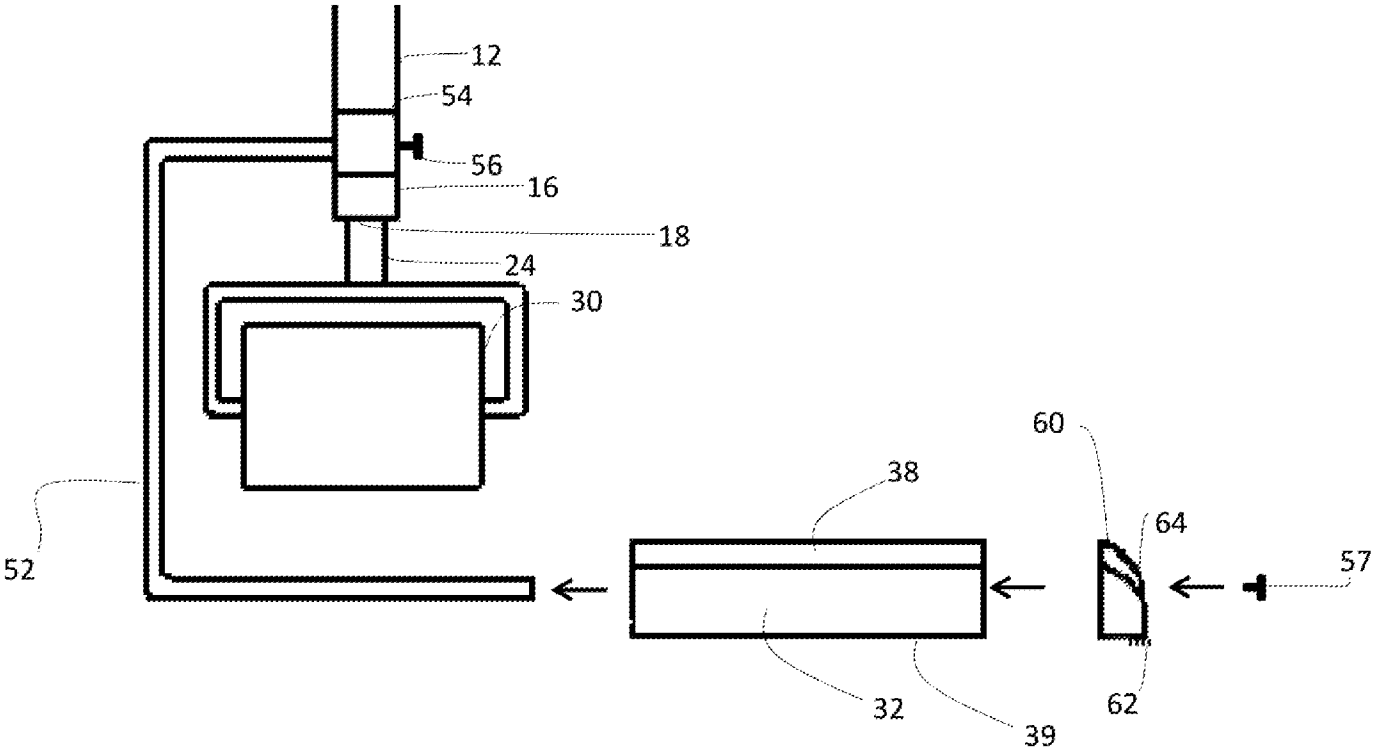
FIG. 10 is an enlarged view of an alternate embodiment of the distal end of the tool of FIG. 1, showing an exploded view and additional detail of a cleaning pad of the tool.
Figure 11:
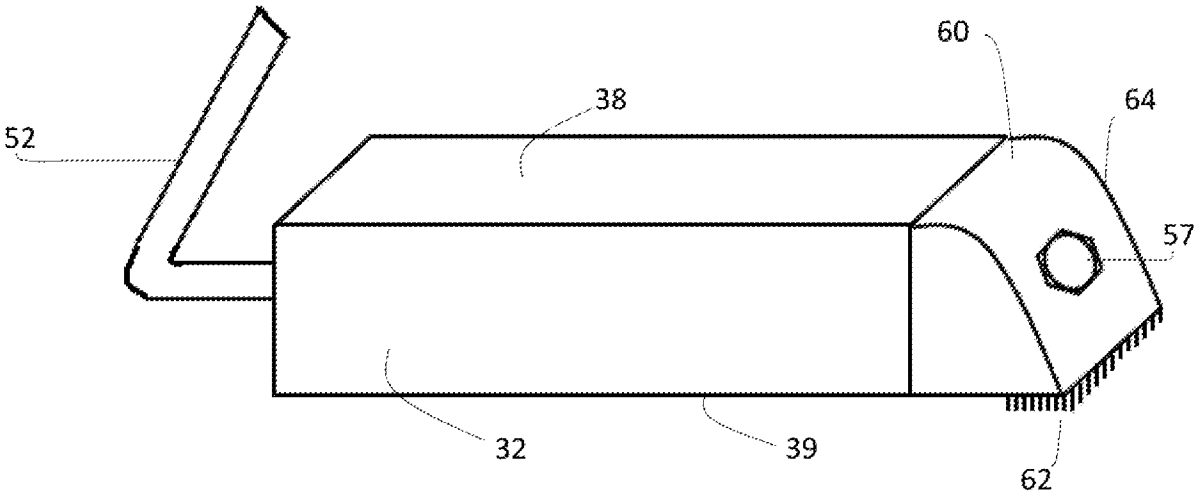
FIG. 11 is an partial, enlarged view of the tool of FIG. 10, showing an assembled view of the cleaning pad.

FIGS. 9-11 show different embodiments of the cleaning pad 32. The cleaning pad 32 may be removably connected to the arm 52. The cleaning pad 32 may have a center channel (not shown) that receives a leg of the U-shaped or J-shaped arm 52. The cleaning pad 32 may then be secured to leg of the U-shaped or J-shaped arm 52 with a mechanical fastener 57, for instance, a fastener threaded onto the distal end of the leg of the arm 52. In one aspect, the cleaning pad 32 may include a sponge-like material that may be soaked with cleaning fluid. In another aspect, the cleaning pad 32 may comprise a semi-rigid, backing core which is configured to receive around its outer surface an absorbent pad. The absorbent pad may be releasably attached to the backing core or may be held in position with the fastener 57. The absorbent pad may absorb the cleaning fluid and may be disposable. In one aspect, the backing core and absorbent pad may be configured with a cooperating hook and loop material so as to allow releasable attachment of the absorbent pad to the backing core. The backing core may be removably attachable from the leg of the U-shaped or J-shaped arm, or may be formed integral or monolithically with the leg of the U-shaped or J-shaped arm. FIG. 10 shows a configuration where the cleaning pad 32 includes a distal brush 60. The distal brush 60 is an attachment to the end of the cleaning pad 32 and allows the user the ability to perform brushing action with the cleaning pad on top surface of the roofing ply, for instance, the installed roofing ply. Often the top surface of the roofing ply may have glue or debris adhered to its top surface. The distal brush 60 facilitates in its removal. The distal brush 60 has bristles 62 on its bottom surface generally in the same plane as the bottom surface 39 of the cleaning pad. The distal brush 60 may be a separate member that may be secured to the distal end of the cleaning pad 32, for instance, to mount the cleaning pad to the U-shaped or J-shaped arm 52. The distal brush 60 may have its own internal threads that engage the distal end of the U-shaped or J-shaped arm. In this configuration, the distal brush 60 may function as the fastener 57. The distal brush 60 may be attached to the U-shaped or J-shaped arm 52 with the mechanical fastener 57 as shown in FIG. 10. The distal brush 60 may be used with cleaning pad 32 configured as a sponge-like member or as a backing core with an absorbent pad attached thereto. The distal brush 60 allows the user to more thoroughly clean certain areas of the seams. The distal brush 60 may have a tapered end 64 to allow the user to easily insert the cleaning pad between the plies. In the alternative, the distal end of the cleaning pad (e.g., without a distal brush) may be formed with a tapered end and/or with bristles to allow the user to insert the cleaning pad between the plies.

Figure 12:
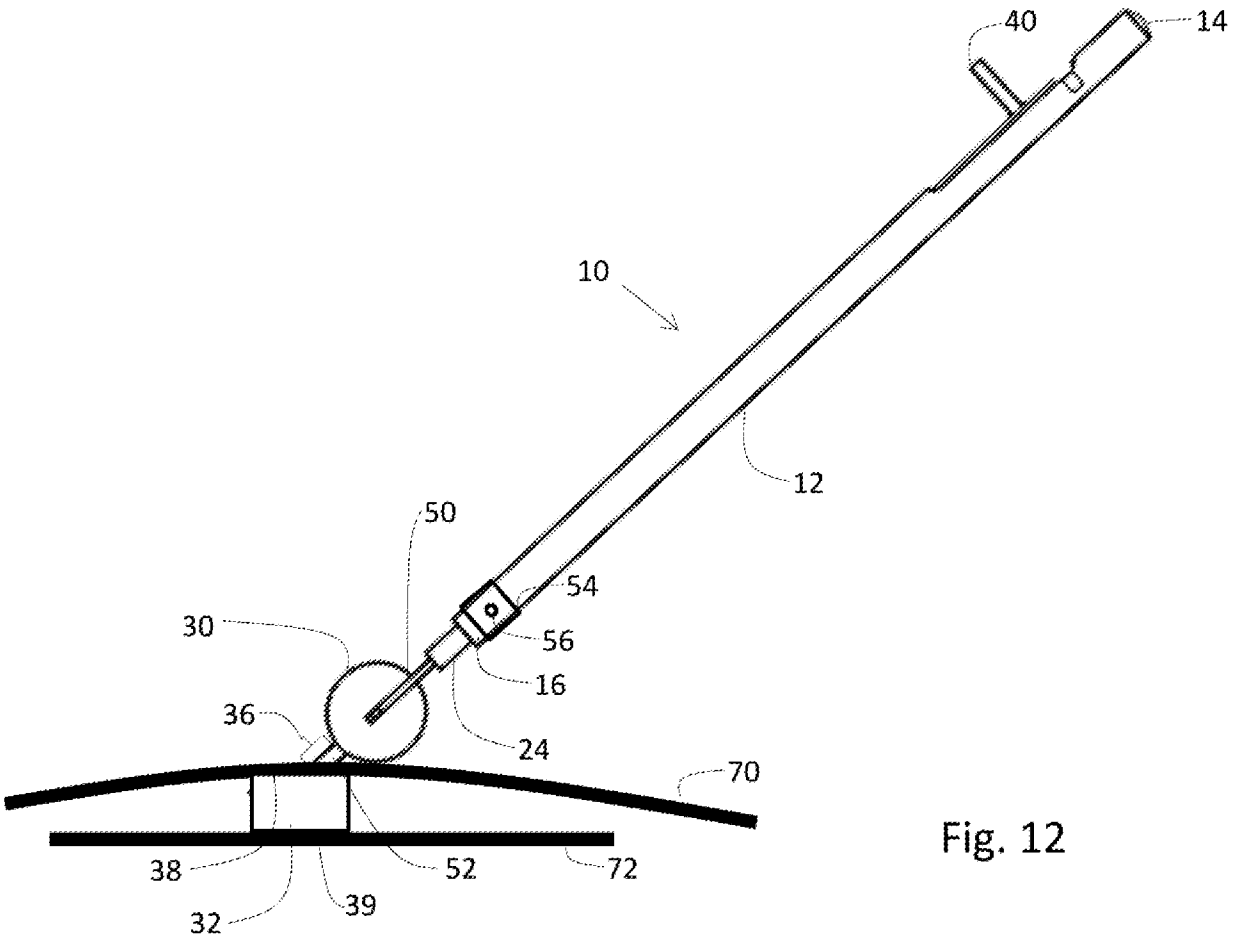
FIG. 12 is a representation demonstrating a use of the tool of FIG. 1.

Referring to FIG. 12, in operation, an edge of a first roofing ply 70 may be arranged adjacent to an edge of a second roofing ply 72. The edge of the first roofing ply may be inserted in the space 36 between the cleaning pad 32 and the roller 30. The tool may be positioned such that a bottom surface 39 of the cleaning pad engages a top surface of the second roofing ply 72 adjacent to the edge of the second roofing ply. The shaft 24 may be moved to the extended position such that the roller 30 applies pressure against the first roofing ply 70 and forces the bottom surface of the first ply against the top surface 38 of the cleaning pad 30. The tool 10 may be advanced along the edges of the first and the second roofing plies 70,72 to clean the top surface of the second roofing ply 72 and the bottom surface of the first roofing ply 70. The user may move the handle 40 downward against the first roofing ply 70 vis-à-vis the roller 30 to engage the top surface 38 of the cleaning pad, and may independently force the tubular member 12 downward to engage the second roofing ply 72 with the bottom surface 39 of the cleaning pad. The user may soak the cleaning pad 32 with cleaning fluid as necessary. The user may also change out the cleaning pad, sponge and/or absorbent pad as necessary. The user may insert the edge of the first roofing ply 70 in the space 36 between the cleaning pad and the roller by positioning the shaft 24 with the handle 40 so the roller 30 moves from the retracted position to the extended position. The user may engage the bristles 62 on the underside of the distal brush 60 against the second roofing ply top surface 72 to clean the second roofing ply top surface. The user may walk along the two plies 70,72 to be seamed together pushing the tool 10 ahead as he walks. If the user wishes to reverse direction, the user may rotate the arm 52 of the cleaning pad with the locking collar 54, so as to create the space 36 on an opposite lateral side of the tubular member and tool. The process may then be repeated.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A roofing tool comprising:

a tubular member having a length with opposite proximal and distal ends, the proximal end being configured to be grasped by a user and the distal end having an opening into a hollow interior of the tubular member;

a shaft having a length with opposite proximal and distal ends, the shaft being disposed in the hollow interior of the tubular member, the shaft proximal end corresponding generally to the tubular member proximal end and the shaft distal end extending through the tubular member distal end opening;

a roller operatively connected to the distal end of the shaft, the roller being configured to rotate about a roller axis, the roller axis being perpendicular to the shaft length;

a cleaning pad operatively connected to the distal end of the tubular member and spaced from the distal end of the tubular member and the roller, the cleaning pad extending in a direction transverse to the tubular member length, the cleaning pad having a top surface and a bottom surface; and wherein the shaft is positionable relative to the tubular member between an extended position and a retracted position, wherein the extended position corresponds to a first distance of a space between the roller and the cleaning pad, wherein the retracted position corresponds to a second distance of the space between the roller and the cleaning pad, wherein the first distance is less than the second distance, and wherein the top surface of the cleaning pad is for cleaning a bottom surface of a first roofing ply, and the bottom surface of the cleaning pad is for cleaning a top surface of a second roofing ply.

2. The roofing tool of claim 1 wherein the shaft proximal end has a handle.

3. The roofing tool of claim 2 wherein the handle is configured to move the shaft between the extended and retracted positions.

4. The roofing tool of claim 3 wherein the handle is configured to rotate the shaft about a shaft axis parallel to the shaft length.

5. The roofing tool of claim 4 wherein the handle is configured to rotate the roller about the shaft axis.

6. A roofing tool comprising:

a tubular member having a length with opposite proximal and distal ends, the proximal end being configured to be grasped by a user and the distal end having an opening into a hollow interior of the tubular member;

a shaft having a length with opposite proximal and distal ends, the shaft being disposed in the hollow interior of the tubular member, the shaft proximal end corresponding generally to the tubular member proximal end and the shaft distal end extending through the tubular member distal end opening;

a roller operatively connected to the distal end of the shaft, the roller being configured to rotate about a roller axis, the roller axis being perpendicular to the shaft length;

a cleaning pad operatively connected to the distal end of the tubular member with an arm, the arm positioning the cleaning pad such that the roller is between the cleaning pad and the distal end of the tubular member, the cleaning pad extending in a direction transverse to the tubular member length, the cleaning pad having a top surface and a bottom surface; and wherein the shaft is positionable relative to the tubular member between an extended position and a retracted position, wherein in the extended position, the shaft proximal end is positioned away from the tubular member proximal end and the roller is positioned toward the cleaning pad and away from the tubular member distal end, wherein in the retracted position the shaft proximal end is positioned toward the tubular member proximal end and the roller is positioned away from the cleaning pad and toward the tubular member distal end, and wherein the top surface of the cleaning pad is for cleaning a bottom surface of a first roofing ply, and the bottom surface of the cleaning pad is for cleaning a top surface of a second roofing ply.

7. The roofing tool of claim 6 wherein the arm connects to the cleaning pad in a manner to form a space sufficient to allow an edge of a roofing ply to pass between the roller and the cleaning pad.

8. The roofing tool of claim 6 wherein the arm is rotatable about a tubular member axis parallel to the tubular member length.

9. The roofing tool of claim 6 wherein the shaft proximal end has a handle.

10. The roofing tool of claim 9 wherein the arm is configured to move between a first position on an outer surface of the tubular member and a second position on a generally laterally opposite position on the outer surface of the tubular member.

11. The roofing tool of claim 6 wherein the cleaning pad is removably attachable to the arm.

12. The roofing tool of claim 6 wherein the cleaning pad has a proximal end adjacent to the arm and a distal end spaced therefrom having a tapered end.

13. The roofing tool of claim 6 wherein the cleaning pad has a proximal end adjacent to the arm and a distal end spaced therefrom having bristles.

14. A method comprising:

accessing a roofing tool wherein the roofing tool comprises a tubular member having a length with opposite proximal and distal ends, the proximal end is configured to be grasped by a user and the distal end has an opening into a hollow interior of the tubular member, the hollow interior receives a shaft having a length with opposite proximal and distal ends, the shaft proximal end corresponds generally to the tubular member proximal end and the shaft distal end extends through the tubular member distal end opening, the distal end of the shaft is operatively connected to a roller, the roller is configured to rotate about a roller axis, the roller axis is perpendicular to the shaft length, the distal end of the tubular member has a cleaning pad spaced therefrom and the roller, the cleaning pad extends in a direction transverse to the tubular member length, the shaft is positionable relative to the tubular member between an extended position and a retracted position, the extended position corresponds to a first distance of the space between the roller and the cleaning pad, the retracted position corresponds to a second distance of the space between the roller and the cleaning pad, the first distance is less than the second distance;

arranging an edge of a first roofing ply adjacent to an edge of a second roofing ply;

inserting the edge of the first roofing ply in the space between the cleaning pad and the roller;

positioning the tool such that a bottom surface of the cleaning pad engages a top surface of the second roofing ply adjacent to the edge of the second roofing ply;

moving the shaft to the extended position such that a top surface of the cleaning pad engages a bottom surface of the first roofing ply adjacent to the edge of the first roofing ply; and advancing the tool along the edges of the first and the second roofing plies to clean the top surface of the second roofing ply and the bottom surface of the first roofing ply.

15. The method of claim 14 wherein the step of moving the shaft to the extended position includes positioning a handle to move the shaft between the extended and retracted positions.

16. The method of claim 15 wherein the step of moving the shaft to the extended position includes positioning the handle to rotate the roller about a shaft axis parallel to the shaft length.

17. The method of claim 16 wherein the step of inserting the edge of the first roofing ply in the space between the cleaning pad and the roller includes rotating an arm about a tubular member axis parallel to the tubular member length wherein the arm operatively connects the cleaning pad to the tubular member distal end and positions the cleaning pad from the roller in a manner to form a space sufficient to allow the edge of the first roofing ply to pass therebetween.

18. The method of claim 14 wherein the step of advancing the tool along the edges of the first and the second roofing plies to clean the top surface of the second roofing ply and the bottom surface of the first roofing ply includes engaging bristles against the second roofing ply top surface, wherein the bristles are disposed on the bottom of the cleaning pad.

* * * * *